US009658587B2

(12) United States Patent
Mori et al.

(10) Patent No.: US 9,658,587 B2
(45) Date of Patent: May 23, 2017

(54) FIXING DEVICE AND IMAGE FORMING APPARATUS

(71) Applicant: FUJI XEROX CO., LTD., Tokyo (JP)

(72) Inventors: Keitaro Mori, Kanagawa (JP); Yuki Yokoyama, Kanagawa (JP); Masayo Higashimura, Kanagawa (JP); Mitsuhiro Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/011,938

(22) Filed: Feb. 1, 2016

(65) Prior Publication Data

US 2017/0090372 A1 Mar. 30, 2017

(30) Foreign Application Priority Data

Sep. 24, 2015 (JP) ..... 2015-187214

(51) Int. Cl.
*G03G 15/20* (2006.01)

(52) U.S. Cl.
CPC ..... *G03G 15/2085* (2013.01)

(58) Field of Classification Search
CPC ..... G03G 15/2017
See application file for complete search history.

(56) References Cited

U.S. PATENT DOCUMENTS 8,081,903 B2 12/2011 Hasegawa
2005/0220507 A1* 10/2005 Uehara ..... G03G 15/2064 399/329

FOREIGN PATENT DOCUMENTS

JP 2010-078659 A 4/2010

* cited by examiner

*Primary Examiner* — Clayton E Laballe
*Assistant Examiner* — Victor Verbitsky
(74) *Attorney, Agent, or Firm* — Oliff PLC

(57) ABSTRACT

A fixing device includes a heating member that has a heat source, comes into contact with a surface of a continuous medium having an image transferred thereto and heats the surface; a pressure member that is provided so as to oppose the heating member with the medium therebetween and applies pressure to the medium; and a tensioning member that is provided on a downstream side of a fixing area, where the heating member and the pressure member oppose each other, in a medium-transport direction, applies tension to the medium by pressing the medium toward the pressure member, and wraps the medium around the pressure member.

5 Claims, 4 Drawing Sheets

FIG. 4

| | | PAPER THICKNESS | |
|---|---|---|---|
| | | LARGE (HIGH TEMPERATURE) | SMALL (LOW TEMPERATURE) |
| SHRINKABILITY | HIGH | LARGE WRAP POSITION + FAN | SMALL WRAP POSITION |
| | LOW | LARGE WRAP POSITION | SEPARATED POSITION |

FIXING DEVICE AND IMAGE FORMING APPARATUS

CROSS-REFERENCE TO RELATED APPLICATIONS

This application is based on and claims priority under 35 USC 119 from Japanese Patent Application No. 2015-187214 filed Sep. 24, 2015.

BACKGROUND

The present invention relates to fixing devices and image forming apparatuses.

SUMMARY

According to an aspect of the invention, there is provided a fixing device includes a heating member that has a heat source, comes into contact with a surface of a continuous medium having an image transferred thereto and heats the surface; a pressure member that is provided so as to oppose the heating member with the medium therebetween and applies pressure to the medium; and a tensioning member that is provided on a downstream side of a fixing area, where the heating member and the pressure member oppose each other, in a medium-transport direction, applies tension to the medium by pressing the medium toward the pressure member, and wraps the medium around the pressure member.

BRIEF DESCRIPTION OF THE DRAWINGS

An exemplary embodiment of the present invention will be described in detail based on the following figures, wherein:

FIGS. 3A to 3C show a tensioning member according to Example 1, wherein FIG. 3A shows a state in which the tensioning member is separated from a medium, FIG. 3B shows a state in which the tensioning member has been moved to a small wrap position, and FIG. 3C shows a state in which the tensioning member has been moved to a large wrap position; and FIG. 4 is a table showing the relationship between the thickness and type of the medium and the corresponding positions of the tensioning member and a cooling member, in the fixing device according to Example 1.

DETAILED DESCRIPTION

Figure 1:
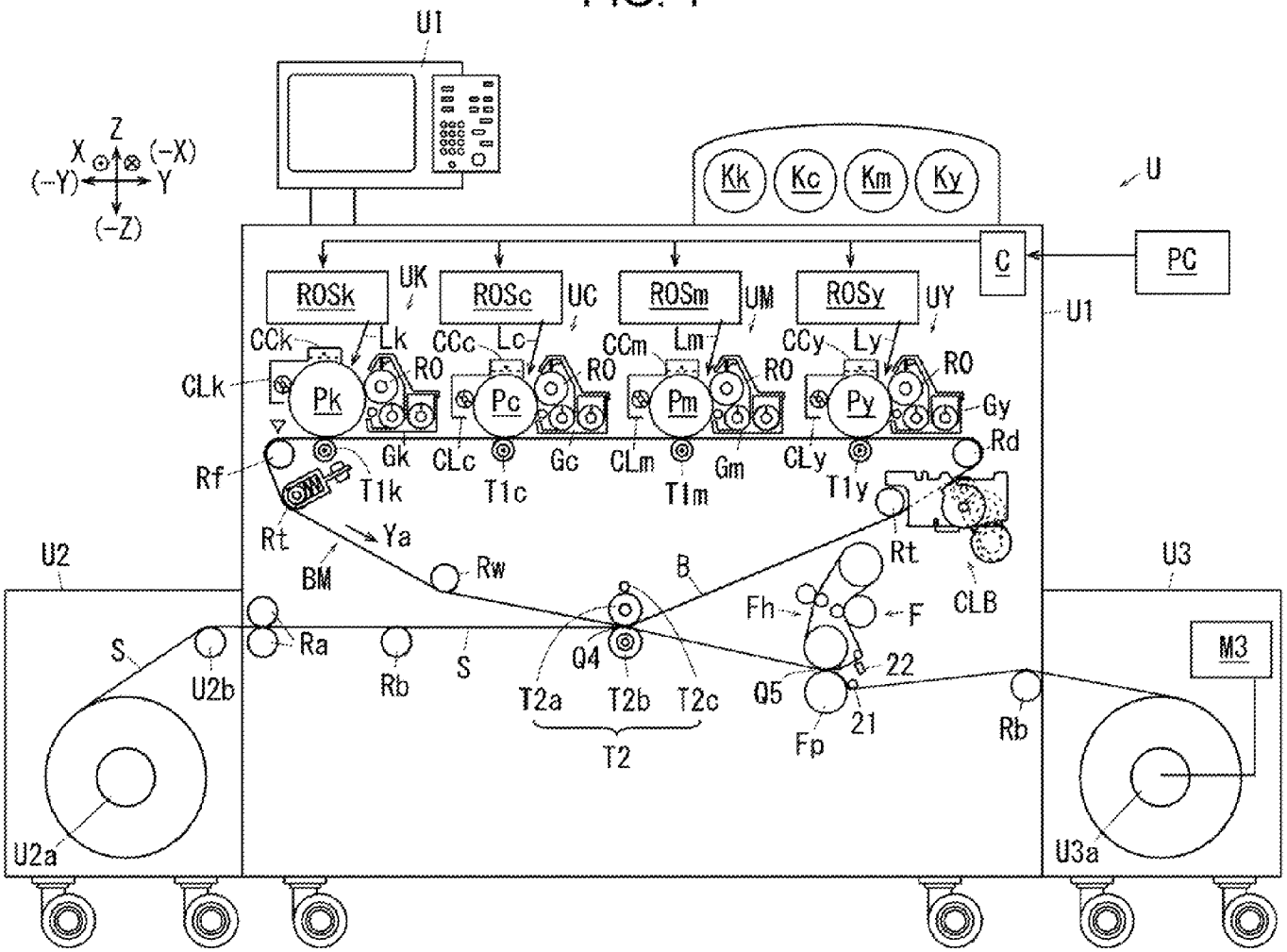
FIG. 1 shows the overall configuration of an image forming apparatus according to Example 1.

Referring to the drawings, a specific example (hereinbelow, referred to as an "example") of an exemplary embodiment of the present invention will be described. However, the present invention is not limited to the example described below.

To ease the understanding of the following description, in the drawings, the front-rear, left-right, and top-bottom directions will be referred to as the X-axis, Y-axis, and Z-axis directions, and the directions indicated by arrows X, −X, Y, −Y, Z, and −Z denote the front, rear, right, left, upper, and lower sides.

Furthermore, in the drawings, the mark formed by a circle (○) and a dot (•) in the circle designates an arrow directed from the back to the front of the drawing, and a mark formed by a circle (○) and a cross (x) in the circle designates an arrow directed from the front to the back of the drawing.

Note that, for the ease of understanding, the components not needed for explanation will not be illustrated in the drawings.

Example 1

FIG. 1 shows the overall configuration of an image forming apparatus according to Example 1.

In FIG. 1, an image forming apparatus U according to Example 1 of the present invention includes a printer unit U1, serving as an example of an image forming part, as well as an example of a recording part. An operating unit UI, serving as an example of an input part, is supported on the upper left side of the printer unit U1. The operating unit UI allows an operator to input information to operate the image forming apparatus U.

The printer unit U1 receives image information transmitted from a personal computer PC, serving as an example of an image-information transmitting device.

A controller C of the image forming apparatus U converts the image information input from the personal computer PC to image information for forming a latent image.

The printer unit U1 includes photoconductors Py, Pm, Pc, and Pk corresponding to yellow (Y), magenta (M), cyan (C), and black (K), serving as an example of image carriers.

In FIG. 1, a charger CCk; an exposure device ROSk, serving as an example of a latent-image forming device; a developing device Gk; a first transfer roller T1*k*, serving as an example of a first transfer device; and a photoconductor cleaner CLk, serving as an example of an image-carrier cleaning device, are arranged around the black photoconductor Pk, in this order in the rotation direction of the photoconductor Pk.

Similarly, the photoconductors Py, Pm, and Pc are also surrounded by chargers CCy, CCm, and CCc, exposure devices ROSy, ROSm, and ROSc, developing devices Gy, Gm, and Gc, first transfer rollers T1*y*, T1*m*, and T1*c*, and photoconductor cleaners CLy, CLm, and CLc.

The printer unit U1 removably supports, at the top, toner cartridges Ky, Km, Kc, and Kk, serving as an example of containers, that contain developer to be supplied to the developing devices Gy to Gk.

An intermediate transfer belt B, serving as an example of an intermediate transfer body, as well as an example of an image carrier, is provided below the photoconductors Py to Pk, and the intermediate transfer belt B is disposed between the photoconductors Py to Pk and the first transfer rollers T1*y* to T1*k*. The back surface of the intermediate transfer belt B is supported by a driving roller Rd, serving as an example of a driving member; a tension roller Rt, serving as an example of a tensioning member; a walking roller Rw, serving as an example of a meandering preventing member; multiple idler rollers Rf, serving as an example of driven members; a backup roller T2*a*, serving as an example of an opposing member for second transfer; and the first transfer rollers T1*y* to T1*k*.

A belt cleaner CLB, serving as an example of an intermediate-transfer-body cleaner, is disposed on the surface of the intermediate transfer belt B, at a position near the driving roller Rd.

The backup roller T2*a* opposes a second transfer roller T2*b*, serving as an example of a transfer member, as well as an example of a second transfer member, with the intermediate transfer belt B therebetween. The second transfer roller T2*b* according to Example 1 is urged against the backup roller T2*a* by a spring (not shown), serving as an example of an urging member.

A contact roller T2*c*, serving as an example of a contact member, is in contact with the backup roller T2*a* to apply, to the backup roller T2*a*, a voltage having an opposite polarity to the polarity of the charged developer.

The backup roller T2*a*, the second transfer roller T2*b*, and the contact roller T2*c* form the second transfer device T2 according to Example 1, and the first transfer rollers T1*y* to T1*k*, the intermediate transfer belt B, the second transfer device T2, and the like form the transfer devices T1, B, and T2 according to Example 1.

A paper-feed unit U2, serving as an example of a medium-feeding part, is disposed to the left of the printer unit U1. The paper-feed unit U2 has a feed roller U2*a*, serving as an example of a medium-feed member. The feed roller U2*a* according to Example 1 is rotatable. The feed roller U2*a* supports rolled continuous paper S, serving as an example of a continuous medium.

A guide roller U2*b*, serving as an example of a guide member, is disposed to the right of the feed roller U2*a*. Furthermore, transport rollers Ra and Rb, serving as an example of medium-transport members, are disposed to the right of the guide roller U2*b*, in the transport direction of the continuous paper S. A second transfer area Q4, where the intermediate transfer belt B and the second transfer roller T2*b* are opposed to each other, is positioned on the downstream side of the transport roller Rb, in the transport direction of the continuous paper S.

Furthermore, a fixing device F is provided on the downstream side of the second transfer area Q4 in the transport direction of the continuous paper S. The fixing device F includes a heating member Fh and a pressure roller Fp, serving as an example of a pressure member. The contact area between the heating member Fh and the pressure roller Fp serves as a fixing area Q5.

A guide roller Rb, serving as an example of a guide member, is disposed on the downstream side of the fixing device F.

A collecting unit U3, serving as an example of a medium collecting part, is provided to the right of the printer unit U1. The collecting unit U3 includes a take-up roller U3*a*, serving as an example of a medium collecting member. The take-up roller U3*a* according to Example 1 receives a driving force from a motor M3, serving as an example of a driving-force source, and takes up the continuous paper S.

Function of Printer Unit

When the image forming apparatus U receives image information sent from the personal computer PC, a job, which is an image-forming operation, is started. When the job is started, the photoconductors Py to Pk, the intermediate transfer belt B, and the like are rotated.

The photoconductors Py to Pk are rotationally driven by driving-force sources (not shown).

The chargers CCy to CCk receive a predetermined voltage and charge the surfaces of the photoconductors Py to Pk.

The exposure devices ROSy to ROSk output laser beams Ly, Lm, Lc, and Lk, serving as an example of light with which latent images are formed, in response to control signals sent from the controller C, to form electrostatic latent images on the charged surfaces of the photoconductors Py to Pk.

The developing devices Gy to Gk develop the electrostatic latent images on the surfaces of the photoconductors Py to Pk into visible images.

The first transfer rollers T1*y* to T1*k* receive a first transfer voltage having the opposite polarity to the polarity of the charged developer and transfer the visible images on the surfaces of the photoconductors Py to Pk to the surface of the intermediate transfer belt B.

The photoconductor cleaners CLy to CLk clean the surfaces of the photoconductors Py to Pk by removing the developer remaining after the first transfer.

When the intermediate transfer belt B passes through a first transfer area opposing the photoconductors Py to Pk, yellow, magenta, cyan, and black images are transferred, in this order, to the intermediate transfer belt B in an overlapping manner. Then, the intermediate transfer belt B passes through the second transfer area Q4 opposing the second transfer device T2. Note that, in the case of a single-color image, an image of one color is transferred and sent to the second transfer area Q4.

The transport roller Ra transports the continuous paper S, extending from the feed roller U2*a*, to the downstream side. The guide roller Rb guides the continuous paper S to the second transfer area Q4.

In the second transfer device T2, a second transfer voltage having the same polarity as the predetermined polarity of the charged developer is applied to the backup roller T2*a* via the contact roller T2*c*, and thus, the image on the intermediate transfer belt B is transferred to the continuous paper S.

The fixing device F heats the continuous paper S passing through the fixing area Q5 while applying pressure, thus fixing the unfixed image on the surface of the continuous paper S.

After the image is fixed, the continuous paper S is wound on the take-up roller U3*a*.

Fixing Device

Figure 2:
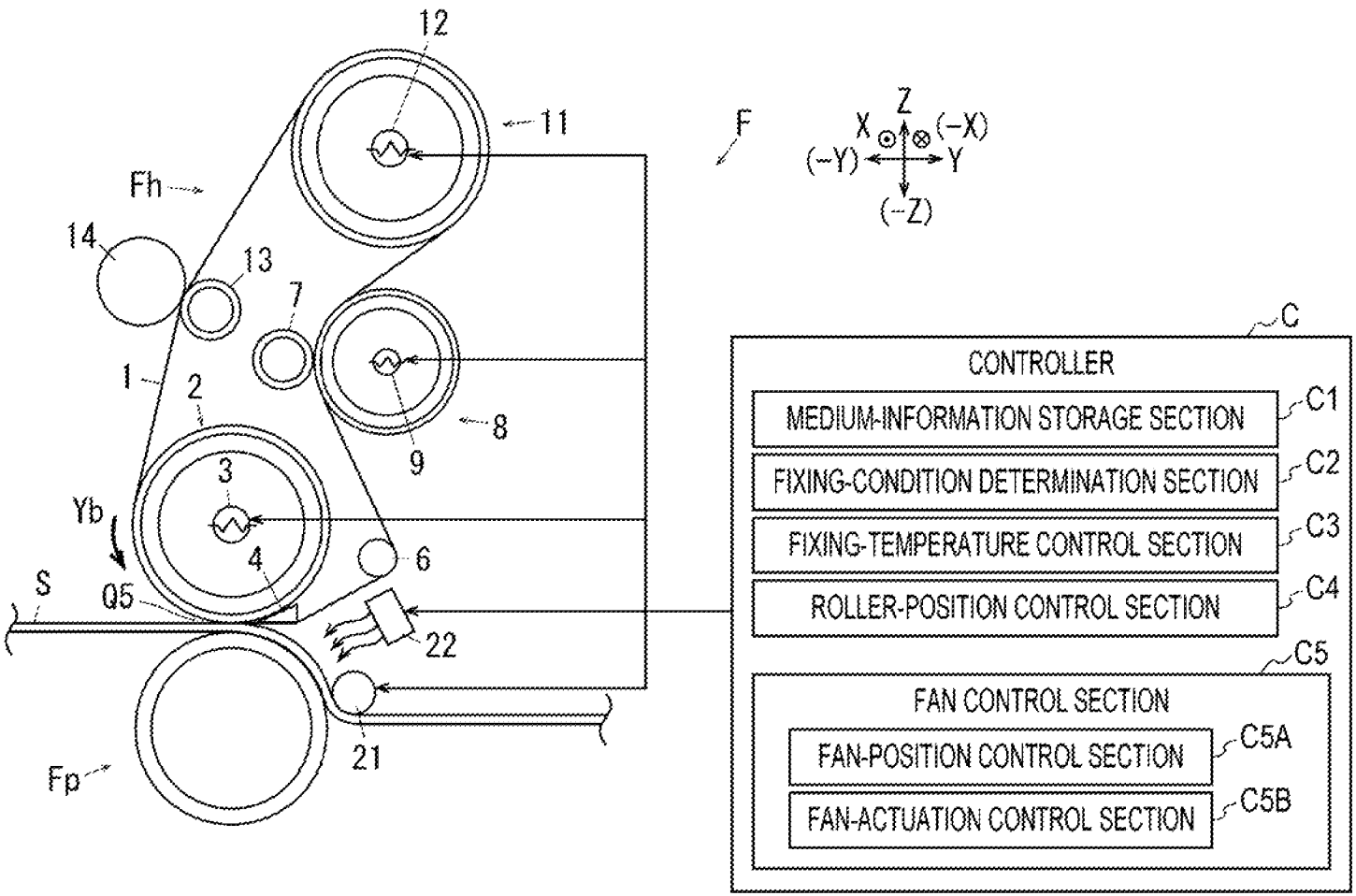
FIG. 2 shows a fixing device according to Example 1.

FIG. 2 shows the fixing device according to Example 1.

In FIGS. 1 and 2, in the fixing device F according to Example 1, the heating member Fh has a heating belt 1, serving as an example of an endless revolving member. A first heating roller 2, serving as an example of a support member, is disposed inside the heating belt 1. The first heating roller 2 is formed in the shape of a hollow cylinder. A first heater 3, serving as an example of a heat source, is provided inside the first heating roller 2.

A fixing pad 4 is provided on the lower right side of the first heating roller 2, inside the heating belt 1. The fixing pad 4 has a wedge shape in section and is disposed between the lower right side portion of the first heating roller 2 and the heating belt 1. The fixing pad 4 according to Example 1 is disposed on the downstream side of the fixing area Q5 and serves to expand the fixing area Q5 in the transport direction.

A first belt support roller 6, serving as an example of a support member for the revolving member, is provided on the upper right side of the fixing pad 4.

A second belt support roller 7, serving as an example of a support member, is provided on the upper left side of the first belt support roller 6, inside the heating belt 1.

A second heating roller 8, serving as an example of a support member, is provided so as to oppose the second belt support roller 7, with the heating belt 1 therebetween. The second heating roller 8 is formed in the shape of a hollow cylinder, similarly to the first heating roller 2. A second heater 9, serving as an example of a heat source, is provided inside the second heating roller 8.

A third heating roller 11, serving as an example of a support member, is provided on the upper right side of the second belt support roller 7, inside the heating belt 1. The third heating roller 11 is formed in the shape of a hollow cylinder, similarly to the heating rollers 2 and 8. A third heater 12, serving as an example of a heat source, is provided inside the third heating roller 11.

A third belt support roller 13, serving as an example of a support member, is provided on the lower left side of the third heating roller 11, inside the heating belt 1.

A fourth belt support roller 14, serving as an example of a support member, is provided so as to oppose the third belt support roller 13, with the heating belt 1 therebetween.

Thus, the heating belt 1 according to Example 1 is rotatable while being tensioned by the rollers 2 to 14. In Example 1, a driving force from a driving-force source (not shown) is transmitted to the first heating roller 2, and the heating belt 1 is revolved.

Figure 3A:
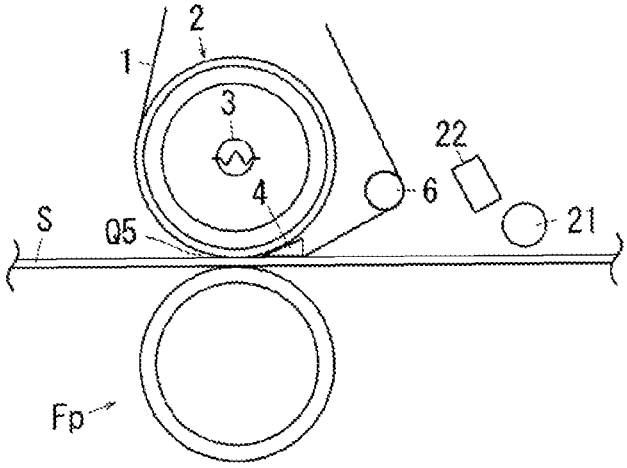
Figure 3B:
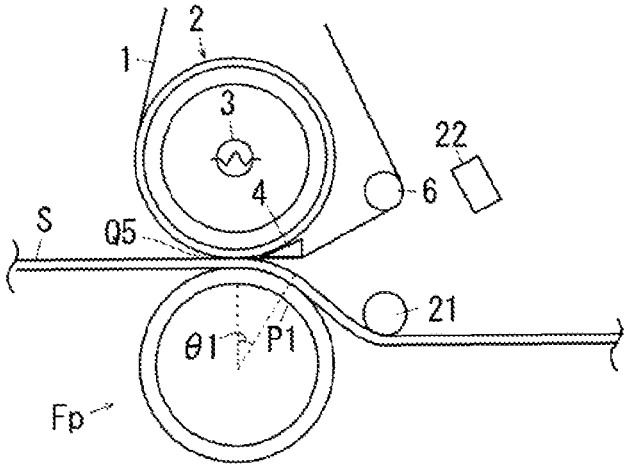
Figure 3C:
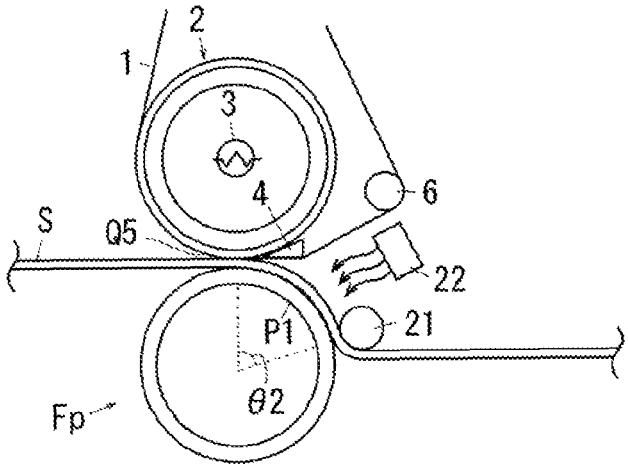

FIGS. 3A to 3C show a tensioning member according to Example 1, wherein FIG. 3A shows a state in which the tensioning member is separated from a medium, FIG. 3B shows a state in which the tensioning member has been moved to a small wrap position, and FIG. 3C shows a state in which the tensioning member has been moved to a large wrap position.

In FIGS. 2 and 3, in the fixing device F according to Example 1, a tensioner roller 21, serving as an example of a tensioning member, is provided on the downstream side of the fixing area Q5. The tensioner roller 21 according to Example 1 is supported so as to be movable among a separated position, as shown in FIG. 3A, where the tensioner roller 21 is separated from the continuous paper S; a small wrap position, as shown in FIG. 3B, where the tensioner roller 21 is in contact with and urges the continuous paper S; and a large wrap position, as shown in FIG. 3C, where the tensioner roller 21 urges the continuous paper S with a force greater than the force exerted at the small wrap position. In FIGS. 3B and 3C, the amount of the continuous paper S wrapped around the pressure roller Fp, e.g., the wrapping angle, is set such that the wrapping angle, θ2, at the large wrap position, shown in FIG. 3C, is greater than the wrapping angle, θ1, at the small wrap position, shown in FIG. 3B. The tensioner roller 21 is configured such that it may be moved by a slider (not shown) and a motor, a gear train, or the like (not shown) for moving the slider, serving as an example of a moving member.

The tensioner roller 21 according to Example 1 is configured to be able to rotate in accordance with the transportation of the continuous paper S, when coming into contact with the continuous paper S. Furthermore, the surface of the tensioner roller 21 according to Example 1 is formed of fluoroplastic, serving as an example of a material with high releasability.

Furthermore, in the respective wrap positions according to Example 1, the tensioner roller 21 comes into contact with the continuous paper S, on the downstream side of a position P1, where the temperature of the developer having passed through the fixing area Q5 decreases to a glass transition temperature as a result of cooling by the pressure roller Fp, described below. Although the position P1 varies to some extent depending on the fixing temperature and whether or not a fan 22 (described below) is actuated, the wrap position of the tensioner roller 21 is set on the downstream side of the most downstream position of the position P1 in the medium-transport direction.

Furthermore, in the fixing device F according to Example 1, the fan 22, serving as an example of a cooling member, is disposed in the vicinity of the tensioner roller 21. The fan 22 according to Example 1 is configured to blow air at the continuous paper S, when actuated. Furthermore, the fan 22 according to Example 1 is supported so as to be movable between a standby position, as shown in FIG. 3A, and a cooling position, as shown in FIGS. 3B and 3C.

Controller According to Example 1

In FIG. 2, the controller C of the image forming apparatus U includes an input/output interface I/O, via which signals are inputted from or outputted to an external device. Furthermore, the controller C includes a read-only memory (ROM), which stores a program, information, and the like for performing necessary processing. The controller C also has a random-access memory (RAM), which temporarily stores necessary data. The controller C also includes a central processing unit (CPU) that performs processing according to the program stored in the ROM and the like. Hence, the controller C according to Example 1 is formed of a compact information processing apparatus, i.e., a so-called microcomputer. Accordingly, by executing the programs stored in the ROM and the like, the controller C realizes various functions.

Function of Controller C

The controller C according to Example 1 has a following function-realizing section.

C1: Medium-Information Storage Section

A medium-information storage section C1 stores information of the continuous paper S. The medium-information storage section C1 according to Example 1 stores the information of the continuous paper S inputted by a user via the operating unit UI. In Example 1, the thickness and type of the continuous paper S are stored as the information of the continuous paper S. The thickness is not limited to the thickness itself, and the weight per unit area may be stored as information related to the thickness. The type that may be stored includes normal paper, resin film, and the like.

C2: Fixing-Condition Determination Section

A fixing-condition determination section C2 determines the fixing temperature, serving as an example of a fixing condition, on the basis of the medium information stored in the medium-information storage section C1. The fixing-condition determination section C2 according to Example 1 determines whether or not the thickness of the medium is larger than a predetermined threshold. The Fixing-condition determination section C2 according to Example 1 also determines whether or not the medium shrinks when heated. Strictly speaking, the normal paper shrinks when heated. However, in Example 1, the normal paper is determined to be of a type that is unlikely to shrink, whereas the resin film is determined to be of a type that is more likely to shrink when heated than the normal paper. The threshold for determining the thickness and the type of the medium that tends to shrink may vary according to the configuration of the image forming apparatus.

C3: Fixing-Temperature Control Section

The fixing-temperature control section C3 controls the fixing temperature, which is the temperature of the fixing area Q5, by controlling the actuation of heaters 3, 9, and 12 of the heating member Fh. When the thickness of the continuous paper S is determined to be large, the fixing-temperature control section C3 according to Example 1 controls such that the heaters 3, 9, and 12 have a second fixing temperature, which is higher than a first fixing temperature, which is used when the thickness of the continuous paper S is determined to be small.

FIG. 4 is a table showing the relationship between the thickness and type of the medium and the corresponding positions of the tensioning member and a cooling member, in the fixing device according to Example 1.

C4: Roller-Position Control Section

A roller-position control section C4, serving as an example of a tensioning-member control section, controls the position of the tensioner roller 21. In FIG. 4, when it is determined that the thickness of the continuous paper S is smaller than a predetermined threshold and that the continuous paper S is of a type that is unlikely to shrink when heated, the roller-position control section C4 according to Example 1 moves the tensioner roller 21 to the separated position, as shown in FIG. 3A. When it is determined that the thickness of the continuous paper S is small and the continuous paper S is of a type that is likely to shrink when heated, the roller-position control section C4 according to Example 1 moves the tensioner roller 21 to the small wrap position, as shown in FIG. 3B. Furthermore, when the thickness of the continuous paper S is large, the roller-position control section. C4 according to Example 1 moves the tensioner roller 21 to the large wrap position, as shown in FIG. 30.

C5: Fan Control Section

A fan control section C5, serving as an example of a cooling-member control section, has a fan-position control section C5A and a fan-actuation control section C5B and controls the operation of the fan 22.

C5A: Fan-Position Control Section

A fan-position control section C5A, serving as an example of a cooling-member position control section, controls the position of the fan 22. When the tensioner roller 21 is moved to the separated position, the fan-position control section C5A according to Example 1 moves the fan 22 to a standby position. When the thickness of the continuous paper S is large and the continuous paper S tends to shrink when heated, the fan-position control section C5A according to Example 1 moves the fan 22 to a cooling position.

C5B: Fan-Actuation Control Section

A fan-actuation control section C5B, serving as an example of a cooling-member actuation control section, controls the actuation of the fan 22. When the fan 22 has been moved to the standby position, the fan-actuation control section C5B according to Example 1 stops the fan 22, and when the fan 22 has been moved to the cooling position, the fan-actuation control section C5B actuates the fan 22.

Effect of Fixing Device According to Example 1

In the image forming apparatus U according to Example 1, which has the above-described configuration, when an image is fixed by the fixing device F, the continuous paper S is heated by the heating member Fh. In the fixing device F according to Example 1, a continuous paper S is used. Hence, unlike the case where individually separated media (so-called cut paper) are used, the continuous paper S exists between the heating member Fh and the pressure roller Fp. When the cut paper is used, the cut paper exists between the heating member Fh and the pressure roller Fp only while it passes through the fixing area Q5, and once the cut paper has passed through the fixing area Q5, the heating member Fh and the pressure roller Fp are in direct contact with each other. Therefore, when the cut paper is used, the heat is directly conducted from the heating member Fh to the pressure roller Fp. In contrast, in Example 1 in which the continuous paper S is used, the pressure roller Fp does not come into direct contact with the heating member Fh, and thus, the temperature of the pressure roller Fp does not increase rapidly, compared with a configuration in which the cut paper is used.

When using the continuous paper S, if the fixing temperature is high or if the medium is of a type that is likely to shrink, the continuous paper S may entirely or partially shrink due to heat applied during fixing, which may result in creases in the continuous paper S or degradation of the image quality.

In contrast, in Example 1, if the fixing temperature is high or if the medium is of a type that is likely to shrink, the tensioner roller 21 is moved to the wrap position. Hence, the continuous paper S is oriented such that it is wrapped around the pressure roller Fp on the downstream side of the fixing area Q5, and the tension is applied to the continuous paper S between the fixing area Q5 and the tensioner roller 21.

Therefore, when the tensioner roller 21 is moved to the wrap position, the continuous paper S comes into contact with the low-temperature pressure roller Fp and is rapidly cooled, compared with a case where the tensioner roller 21 is not moved to the wrap position. At this time, cooling is performed while the tensioner roller 21 is applying tension to the continuous paper S, which tends to shrink. Thus, thermal deformation, such as shrinkage, of the continuous paper S is reduced, and the degradation of the image quality is suppressed, compared with a conventional configuration in which the tensioner roller 21 is not provided.

In particular, in Example 1, the tensioner roller 21 comes into contact with the surface having an image fixed in the fixing area Q5. When the tensioner roller 21 comes into contact with the image at a higher temperature than the glass transition temperature, a problem, such as deposition of the developer on the tensioner roller 21, may occur. However, in Example 1, the tensioner roller 21 is in contact with the continuous paper S on the downstream side of the position P1, where the temperature of the developer having passed through the fixing area Q5 decreases to the glass transition temperature. Hence, in Example 1, degradation of the image quality is reduced, compared with a configuration in which the tensioner roller 21 comes into contact with the image on the upstream side of the position P1.

In addition, in Example 1, the surface of the tensioner roller 21 is formed of a material with high releasability. Therefore, compared with a configuration in which a material with low releasability is used, the image is unlikely to attach to the tensioner roller 21 when the tensioner roller 2 comes into contact with the image on the continuous paper S. Hence, degradation of the quality of the image printed on the continuous paper S is reduced.

In Example 1, when the fixing temperature is high, the tensioner roller 21 is moved to the large wrap position. Therefore, the length over which the continuous paper S is in contact with the pressure roller Fp increases, whereby the continuous paper S is rapidly cooled, compared with a configuration in which the tensioner roller 21 is not moved to the large wrap position. If the continuous paper S is not rapidly cooled, large shrinkage may occur. However, compared with such a case, the shrinkage of the continuous paper S and negative influence on the image quality are suppressed.

Furthermore, in Example 1, when the fixing temperature is high and the continuous paper S is of a type that is likely to shrink, the fan 22 is actuated to blow air at the continuous paper S. Hence, compared with a configuration in which the fan 22 is not actuated, cooling of the continuous paper S is facilitated.

Modification

Although the example of the present invention has been described in detail above, the present invention is not limited to the above-described example, and it may be variously modified within the scope of the present invention as defined in the claims. Modifications (H01) to (H06) of the present invention will be described below, as examples.

(H01) Although the image forming apparatus U, serving as an example of an image forming apparatus, has been described in the above-described example, the present invention may also be applied to printers, facsimile machines, and multifunction machines having these functions. Although an image forming apparatus that uses four colors (Y, M, C, and K) has been described, the present invention may also be applied to single-color image forming apparatuses and to image forming apparatuses that use less than four colors or more than four colors. Furthermore, although a tandem-type image forming apparatus has been shown as an example, the present invention may also be applied to rotary-type image forming apparatuses.

(H02) Although the tensioner roller 21 desirably has a rotatable roller shape in the above-described example, the tensioner roller 21 may also be formed in the shape of, for example, a contact member that does not rotate, e.g., a so-called pad shape.

(H03) Although the surface of the tensioner roller 21 is desirably formed of a material with high releasability in the above-described example, a material with low releasability may also be employed. When the developer is unlikely to attach to the surface of the tensioner roller 21 even at a temperature higher than or equal to the glass transition temperature due to the compatibility among the developer, the medium, and the material with high releasability provided on the surface of the tensioner roller 21, the tensioner roller 21 may be provided on the upstream side of the position P1, where the temperature of the developer decreases to the glass transition temperature.

(H04) Although a configuration example in which the tensioner roller 21 is moved among the small wrap position, the large wrap position, and the separated position has been described in the above-described example, the configuration is not limited thereto. For example, a configuration in which there is no small wrap position or the large wrap position but there is only a single wrap position is possible. At this time, it may be configured such that the tensioner roller 21 is made immovable and fixed at the wrap position, while eliminating the separated position.

Conversely, it may be configured such that the wrap position includes three or more positions, instead of the two positions, namely, the small wrap position and the large wrap position, or such that the wrap position is changed continuously. For example, it may be configured such that the amount of wrap increases with increasing temperature.

Furthermore, in FIG. 4, it may be configured such that, when the thickness of the paper is small and the paper is unlikely to shrink, the tensioner roller 21 is held at the small wrap position, while eliminating the separated position.

(H05) In the above-described example, the condition under which the air is blown by the fan 22 is not limited to that described above, but may be changed such that the air is constantly blown or such that the air is blown when the fixing temperature is high. Furthermore, a configuration without the fan 22 is also possible. Although the fan 22 has been shown as an example cooling member, the present invention is not limited thereto, and a desired cooling member, such as a cooling member that comes into contact with the continuous paper S to cool the continuous paper S through heat conduction may also be employed. Furthermore, although the fan 22 has been configured to be movable between the standby position and the cooling position, the fan 22 may also be configured such that it is immovable or movable among more than two positions.

(H06) Although an example configuration in which the shrinkability is determined on the basis of the type of the medium has been described in the above-described example, the configuration is not limited thereto. For example, it may be configured such that a mark is provided on the medium, the amount of extension and shrinkage is measured with a sensor before and after fixing, and the shrinkability is determined on the basis of whether or not the measured amount of extension and shrinkage is larger than a predetermined threshold. Similarly, the thickness and the fixing temperature may also be measured with sensors to determine whether or not the thickness of the medium is larger than the threshold of the thickness and whether or not the fixing temperature is larger than the threshold of the fixing temperature. Furthermore, it may be configured such that a table, such as a look-up table, of thickness, shrinkability, and fixing temperature is stored, and the position of the tensioner roller 21 is determined on the basis of the measured values of the thickness, shrinkability, and fixing temperature.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating member that has a heat source and a heating belt that extends around the heat source thereby defining a heating belt perimeter around the heat source, the heating belt being arranged to come into contact with a surface of a continuous medium having an image transferred thereto and heat the surface;

a pressure member that is provided so as to oppose the heating member with the medium therebetween at a fixing area and apply pressure to the medium; and a tensioning member that (i) is provided outside of the heating belt perimeter and at a downstream side of the fixing area in a medium-transport direction, (ii) applies tension to the medium by pressing the medium toward the pressure member, and (iii) wraps the medium around the pressure member.

2. The fixing device according to claim 1, further comprising a cooling member for cooling the medium, the cooling member being provided at a position on the downstream side of the fixing area and on an upstream side of the tensioning member, in the medium-transport direction.

3. The fixing device according to claim 1, wherein the amount of medium wrapped around the pressure member by the tensioning member is relatively more when a thickness of the medium is larger than a predetermined threshold, and is relatively less when the thickness is lower than or equal to the predetermined threshold.

4. A fixing device comprising:

a heating member that has a heat source, comes into contact with a surface of a continuous medium having an image transferred thereto and heats the surface;

a pressure member that is provided so as to oppose the heating member with the medium therebetween at a fixing area and apply pressure to the medium; and a tensioning member that (i) is provided on a downstream side of the fixing area in a medium-transport direction, (ii) applies tension to the medium by pressing the medium toward the pressure member, and (iii) wraps the medium around the pressure member, wherein a surface of the tensioning member is formed of a material with high releasability.

5. An image forming apparatus comprising:

an image carrier;

a transfer device that transfers an image on a surface of the image carrier to a continuous medium; and a fixing device for fixing the image transferred to the medium, the fixing device comprising:

a heating member that has a heat source and a heating belt that extends around the heat source thereby defining a heating belt perimeter around the heat source, the heating belt being arranged to come into contact with a surface of a continuous medium having an image transferred thereto and heat the surface;

a pressure member that is provided so as to oppose the heating member with the medium therebetween at a fixing area and apply pressure to the medium; and a tensioning member that (i) is provided outside of the heating belt perimeter at a downstream side of the fixing area in a medium-transport direction, (ii) applies tension to the medium by pressing the medium toward the pressure member, and (iii) wraps the medium around the pressure member.

* * * * *